US009644913B2

(12) United States Patent
Dextraze

(10) Patent No.: US 9,644,913 B2
(45) Date of Patent: May 9, 2017

(54) MULTI-STAGE TRIGGER MECHANISM FOR RIFLE

(71) Applicant: Serge Dextraze, St-Jean-sur-Richelieu (CA)

(72) Inventor: Serge Dextraze, St-Jean-sur-Richelieu (CA)

(73) Assignee: CADEQUIP, INC., Quebec (CA)

( * ) Notice: Subject to any disclaimer, the term of this patent is extended or adjusted under 35 U.S.C. 154(b) by 210 days.

(21) Appl. No.: 14/690,357

(22) Filed: Apr. 17, 2015

(65) Prior Publication Data

US 2016/0305730 A1 Oct. 20, 2016

(51) Int. Cl.
*F41A 19/00* (2006.01)
*F41A 19/10* (2006.01)
*F41A 19/12* (2006.01)

(52) U.S. Cl.
CPC ..... *F41A 19/10* (2013.01); *F41A 19/12* (2013.01)

(58) Field of Classification Search
CPC ..... F41A 19/10; F41A 19/12
USPC ..... 42/69.01
See application file for complete search history.

(56) References Cited

U.S. PATENT DOCUMENTS 6,553,706 B1 4/2003 Gancarz et al.
6,772,548 B1 * 8/2004 Power ..... F41A 19/10 42/69.03
D597,626 S * 8/2009 Krieger ..... D22/108
8,220,193 B1 * 7/2012 Lynch ..... F41A 17/48 42/70.08
8,250,799 B2 * 8/2012 Duperry ..... F41A 19/10 42/42.02
8,677,665 B1 * 3/2014 Huber ..... F41A 19/12 42/69.01
8,893,607 B2 * 11/2014 Audibert ..... F41A 19/10 42/69.01
8,966,802 B1 * 3/2015 Findlay ..... F41A 19/10 42/69.01
9,046,313 B1 * 6/2015 Lutton ..... F41A 17/46
9,310,150 B1 * 4/2016 Geissele ..... F41A 19/16
2009/0183414 A1 * 7/2009 Geissele ..... F41A 19/10 42/69.03
2010/0024273 A1 * 2/2010 Duperry ..... F41A 19/16 42/69.01
2011/0079137 A1 * 4/2011 Audibert ..... F41A 19/10 89/136
2015/0253094 A1 * 9/2015 Reynolds ..... F41A 19/12 42/69.01
2015/0253095 A1 * 9/2015 Wilson ..... F41A 19/14 42/69.01
2015/0308769 A1 * 10/2015 Audibert ..... F41A 19/10 42/69.01
2016/0010933 A1 * 1/2016 Bonner ..... F41A 19/14 42/69.01
2016/0054084 A1 * 2/2016 Bender ..... F41A 19/14 42/69.01

(Continued)

*Primary Examiner* — Michelle R Clement
(74) *Attorney, Agent, or Firm* — FisherBroyles, LLP; Anthony J. DoVale

(57) ABSTRACT

A trigger mechanism for a firearm is presented. The trigger mechanism has a trigger housing, a sear, a sear block and a trigger lever. Actuation of the trigger causes the trigger lever to rotate and eventually come into contact and move the sear block, which permits the sear to fall and permit the actuation of the firing mechanism.

30 Claims, 9 Drawing Sheets

(56) References Cited

U.S. PATENT DOCUMENTS

2016/0131449 A1* 5/2016 Horch ..... F41A 19/16
42/69.01

* cited by examiner

MULTI-STAGE TRIGGER MECHANISM FOR RIFLE

FIELD OF THE INVENTION

This invention relates generally to trigger mechanism. More specifically, the invention relates to a multi-stage trigger mechanism for a rifle.

BACKGROUND OF THE INVENTION

The invention is particularly suited for use in bolt action rifles, but with minor physical modifications could be more widely usable. Triggers now in use are designed for either single-stage or two-stage operation only are limited to narrow ranges of trigger pull weights and travel. Design geometry requires removal of the receiver from the stock or the trigger from the receiver to affect significant changes in either weight or pull or trigger travel.

Every user of a firearm, such as a rifle, for highly accurate target or hunting purposes has a preferred trigger pull. Substantially all known trigger mechanisms have a spring bias imparted to the trigger to resist the pulling movement of the operator. The adjustment of the compression or tension forces in the spring opposing the movement of the trigger will provide an adjustment in resisting force of the trigger to the pulling action. Some shooters prefer what is known as a two-stage pull. In the first stage, the trigger moves against a pre-selected spring resistance to a position just short of that required to release the sear and effect the firing of the firearm. At the end of the first stage pull, the trigger encounters additional resistance which indicates to the operator that it is ready for firing with minimum additional trigger travel. The extent of such first stage pull and the amount of additional resistance imparted to the trigger upon entering the second stage is a matter of choice of the firearm operator. The two stage approach provides a level of safety without the use of a traditional safety mechanism.

It is accordingly an object of this invention to provide an improved trigger mechanism.

SUMMARY

Presented herein is a trigger mechanism for a firearm. In one aspect, the trigger mechanism comprises a trigger housing having a front, back, top, and bottom. In this aspect, the trigger housing has two spaced side plate elements mountable below the firing mechanism. The trigger mechanism also comprises a trigger assembly body therebetween a portion of the two spaced vertical plate elements;

The trigger mechanism also has a sear pivotally mounted between the plate elements and releasably engagable with a portion of the firing mechanism. The trigger mechanism comprises a sear block pivotally mounted between the plate elements and has a distal portion releasably engageable with a portion of the sear. The distal portion supports the weight of the sear and the force associated with the sear spring to prevent the sear from falling until desired.

The trigger mechanism comprises a trigger lever pivotally mounted between the plate elements adjacent the sear block in side-by-side relation. In this aspect, the proximal portion of the trigger lever is connected with a portion of the trigger.

Actuation of the trigger by the user causes the trigger lever to rotate forward during a first stage. In a second stage, the trigger lever will come into contact with the a portion of the sear block, causing the trigger lever to engage the sear block and move it forward and out of engagement with the sear, which in turn permits the sear to move from the first position to the second position, whereby it falls and permits the actuation of the firing mechanism.

Related methods of operation are also provided. Other apparatuses, methods, systems, features, and advantages of the multi-stage trigger mechanism will be or become apparent to one with skill in the art upon examination of the following figures and detailed description. It is intended that all such additional apparatuses, methods, systems, features, and advantages be included within this description, be within the scope of the multi-stage trigger mechanism, and be protected by the accompanying claims.

DESCRIPTION OF THE FIGURES

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DESCRIPTION OF THE INVENTION

Figure 1:
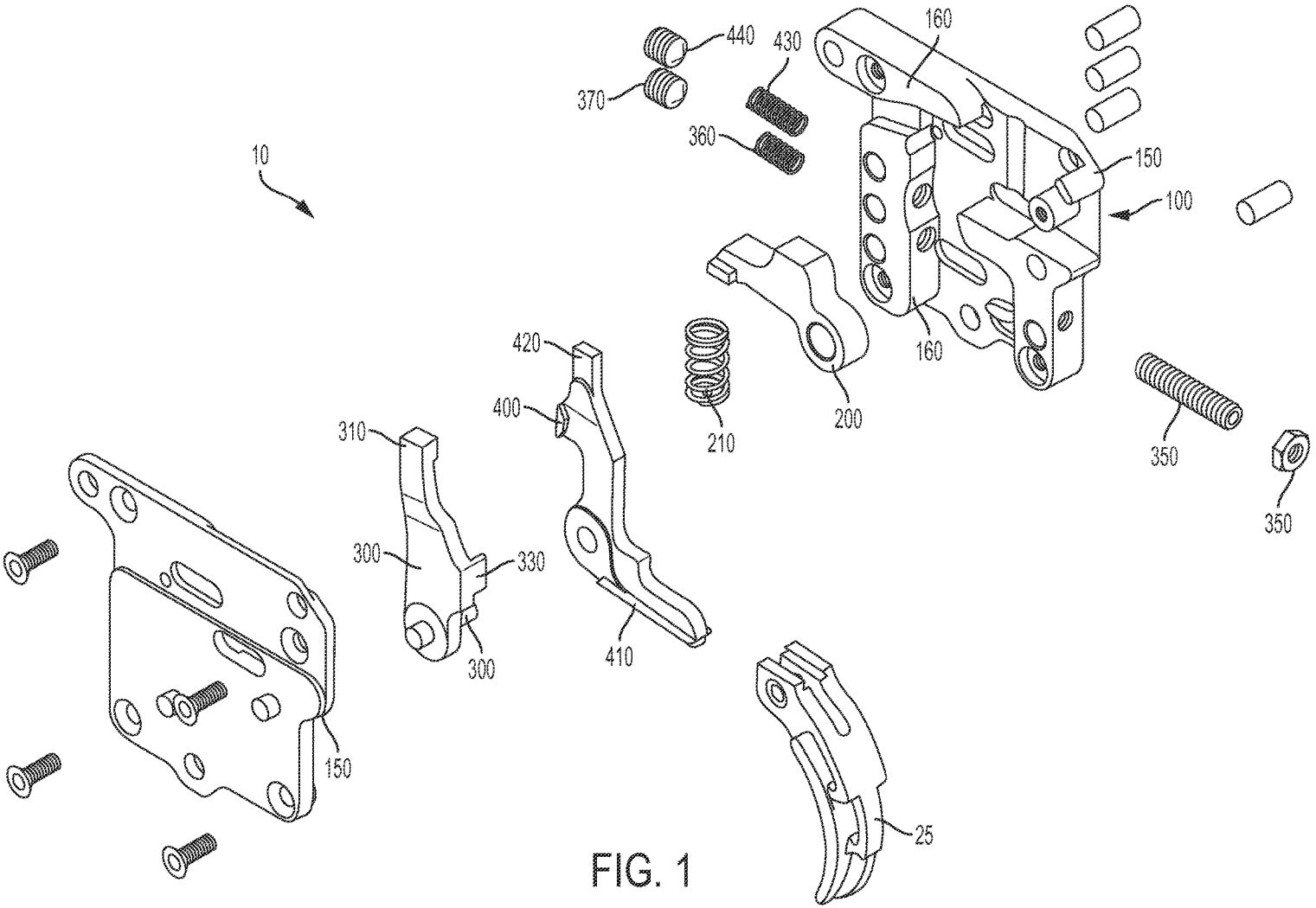
FIG. 1 is an exploded perspective view of one aspect of a trigger mechanism.
Figure 2:
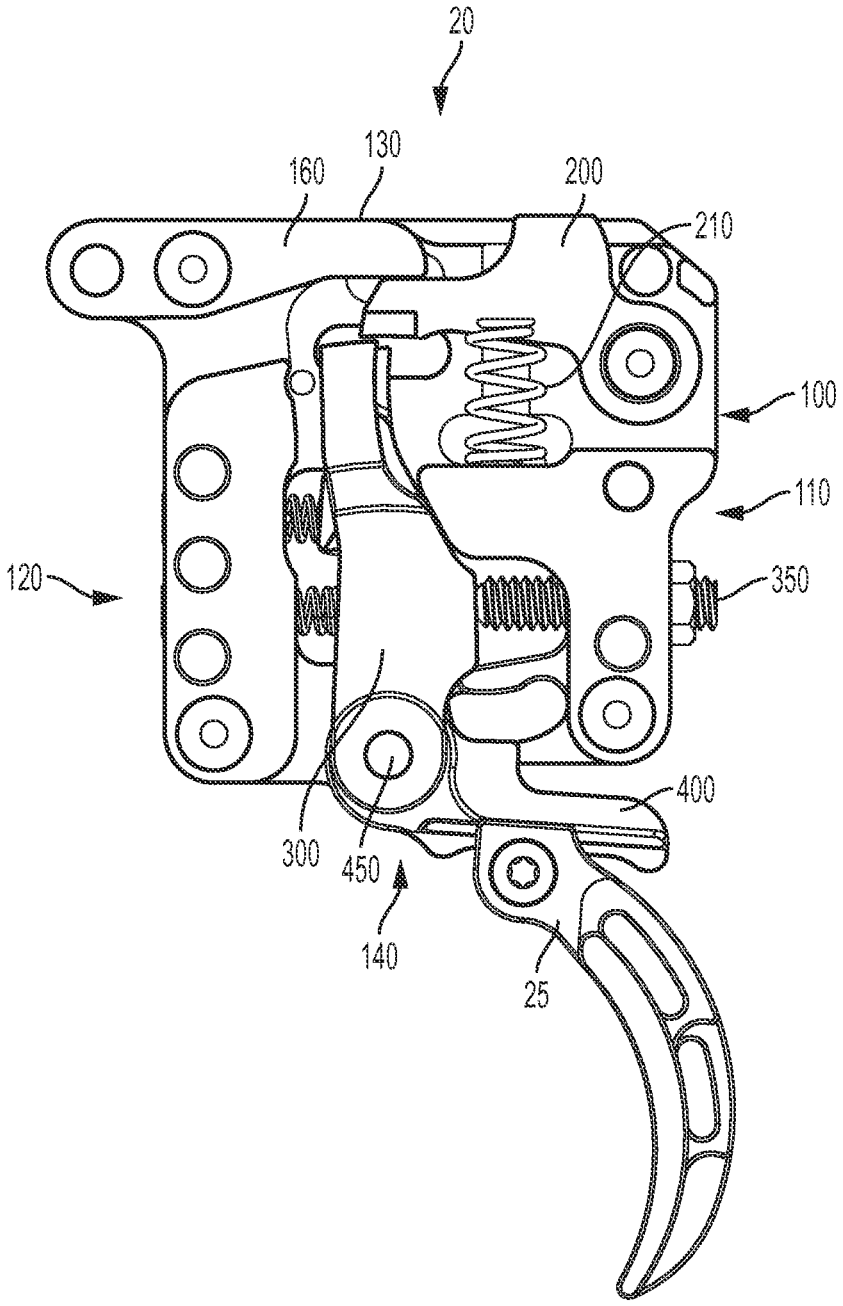
FIG. 2 is a partially transparent side view of the trigger mechanism of FIG. 1.
Figure 3:
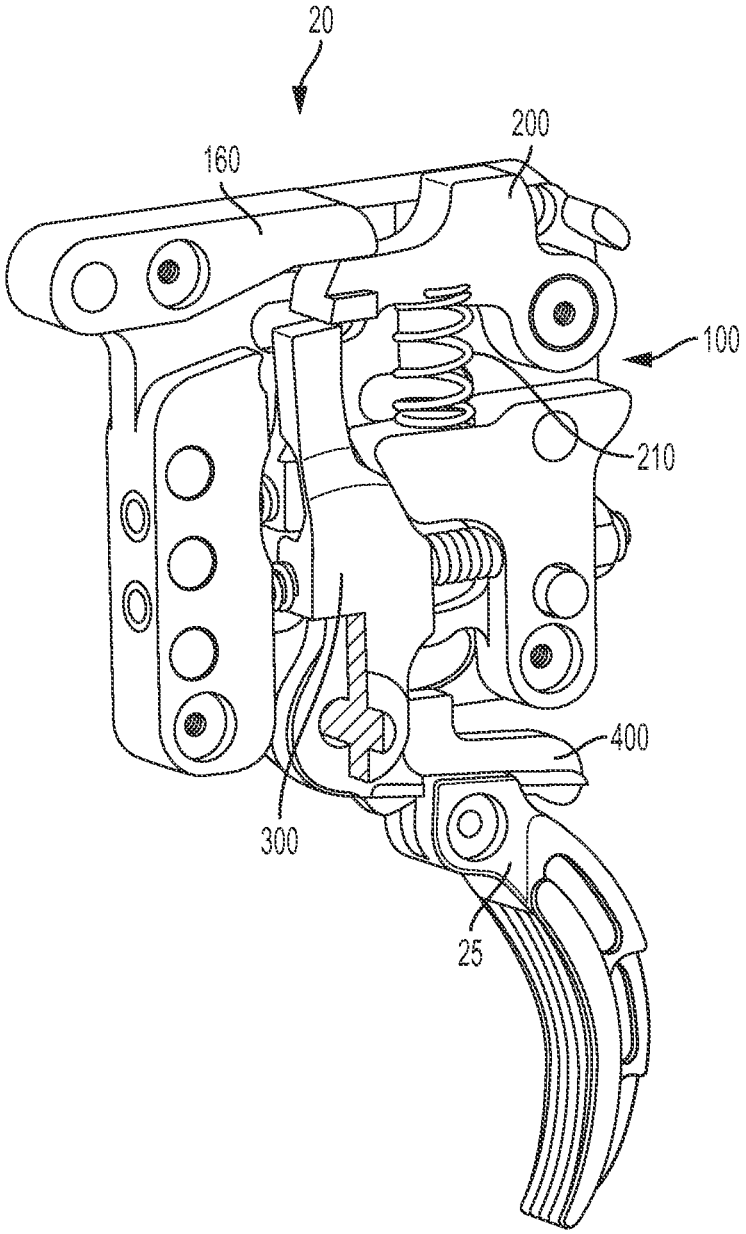
FIG. 3 is a partially transparent perspective view of the trigger mechanism of FIG. 1.
Figure 4:
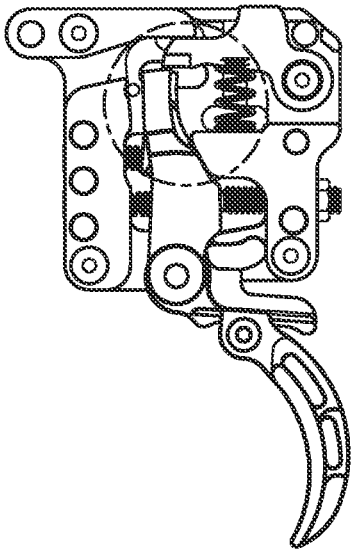
FIG. 4 is a partially transparent side view of the trigger mechanism of FIG. 1 with the sear in a first position, associated with a cocked firing mechanism.
Figure 4A:
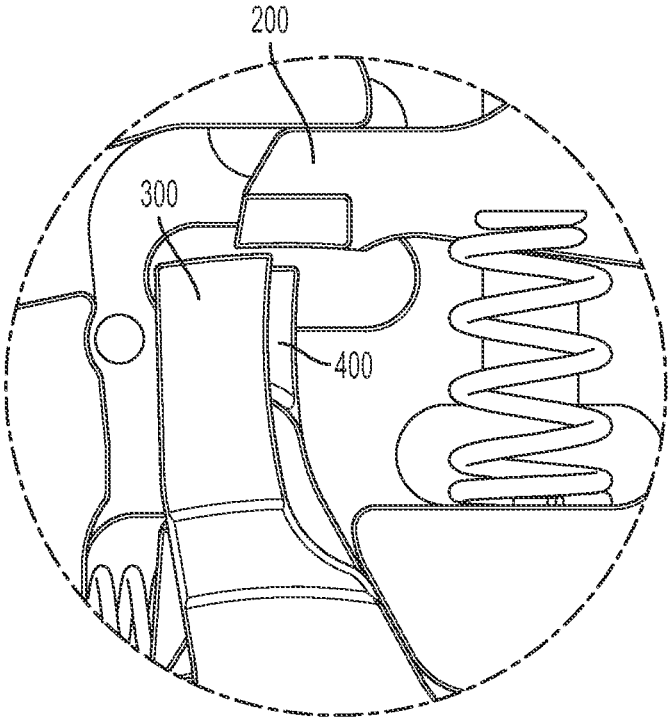
FIG. 4*a* is a section view of section 4*a* of FIG. 4, showing the sear block and trigger lever prior to be actuated by the trigger.
Figure 5:
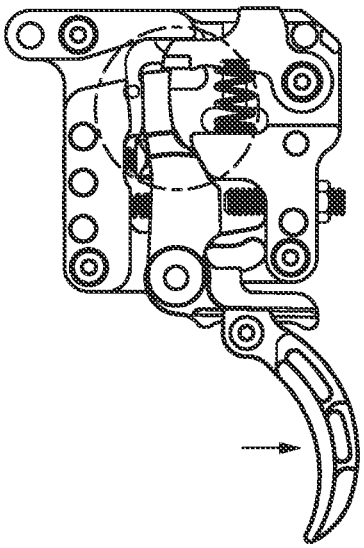
FIG. 5 is a partially transparent side view of the trigger mechanism of FIG. 1 with the sear still in the first position.
Figure 5A:
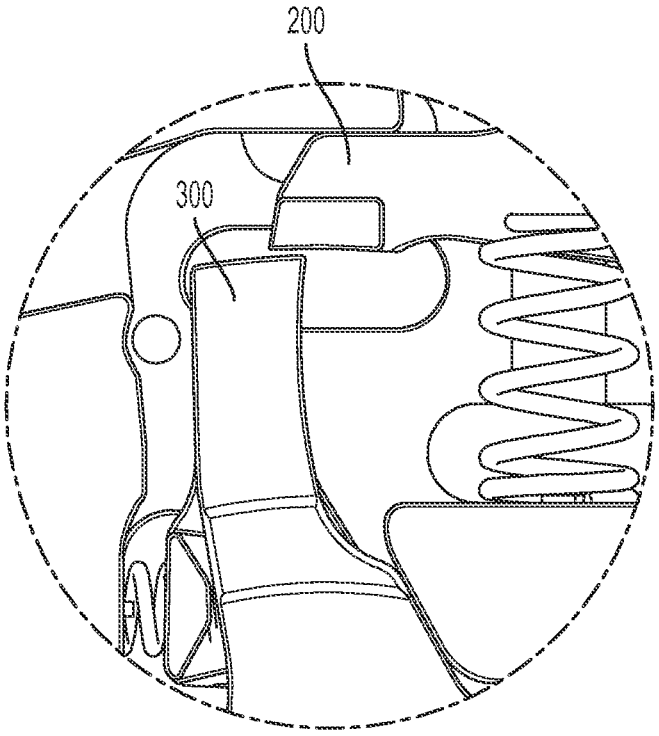
FIG. 5*a* is a section view of section 5*a* of FIG. 5, showing the trigger lever moved forward and the sear block still in engagement with the sear.
Figure 6:
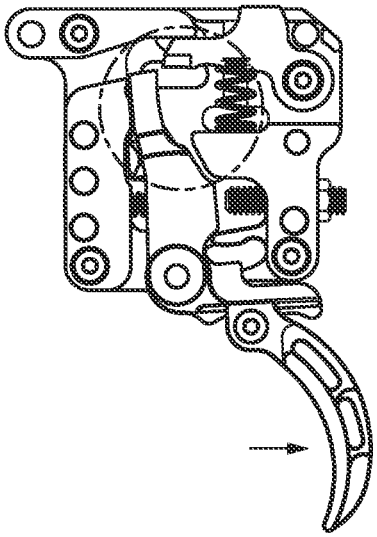
FIG. 6 is a partially transparent side view of the trigger mechanism of FIG. 1, showing the sear moving into the second position and about to drop.
Figure 6A:
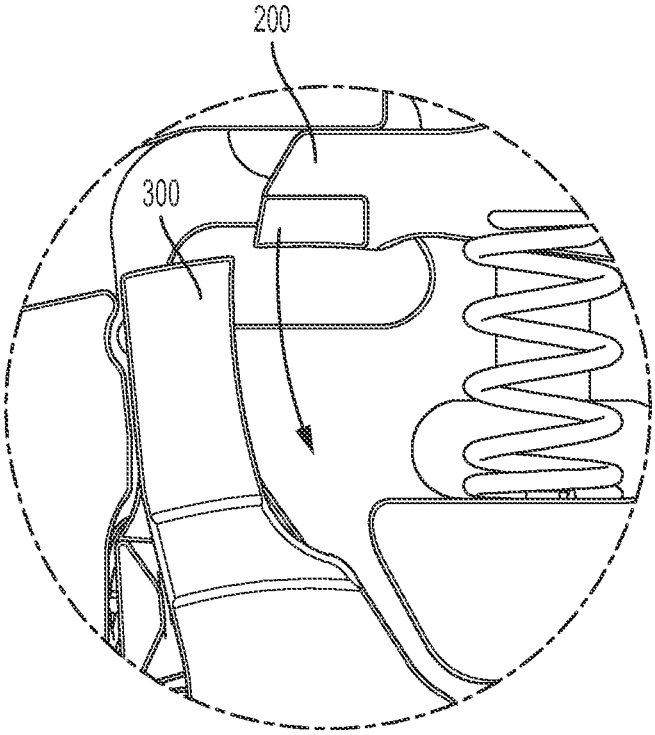
FIG. 6*a* is a section view of section 6*a* of FIG. 6, showing the trigger lever and the sear block moved forward and out of engagement with the sear.
Figure 7:
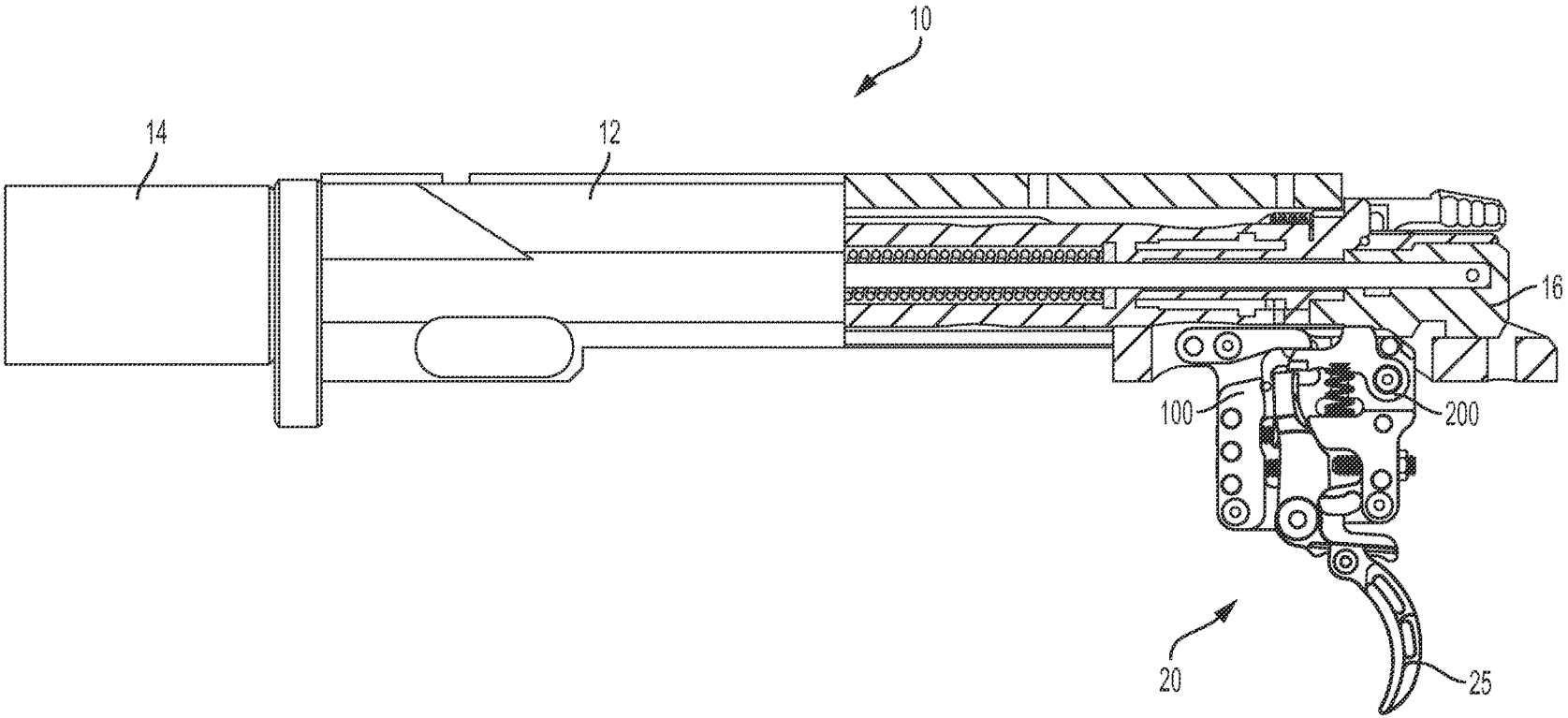
FIG. 7 is a firearm having the trigger mechanism of FIG. 1.
Figure 8:
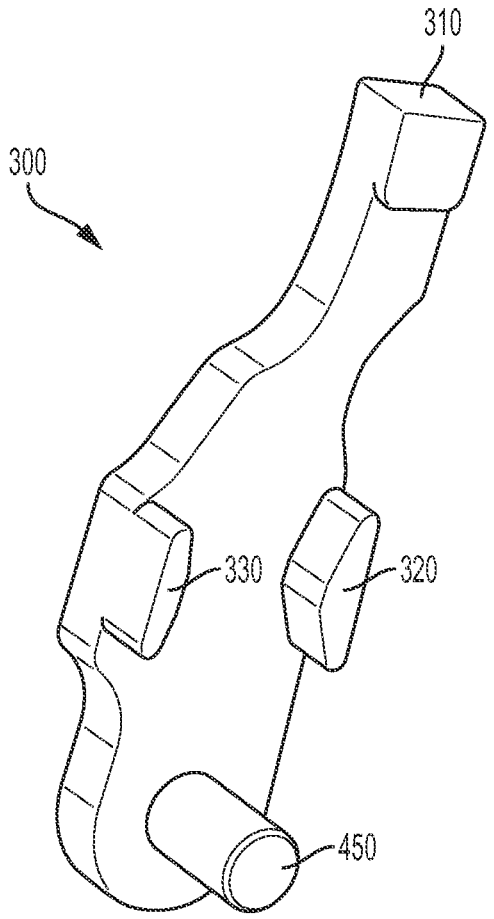
FIG. 8 is a perspective view of a sear associated with the trigger mechanism of FIG. 1.
Figure 9:
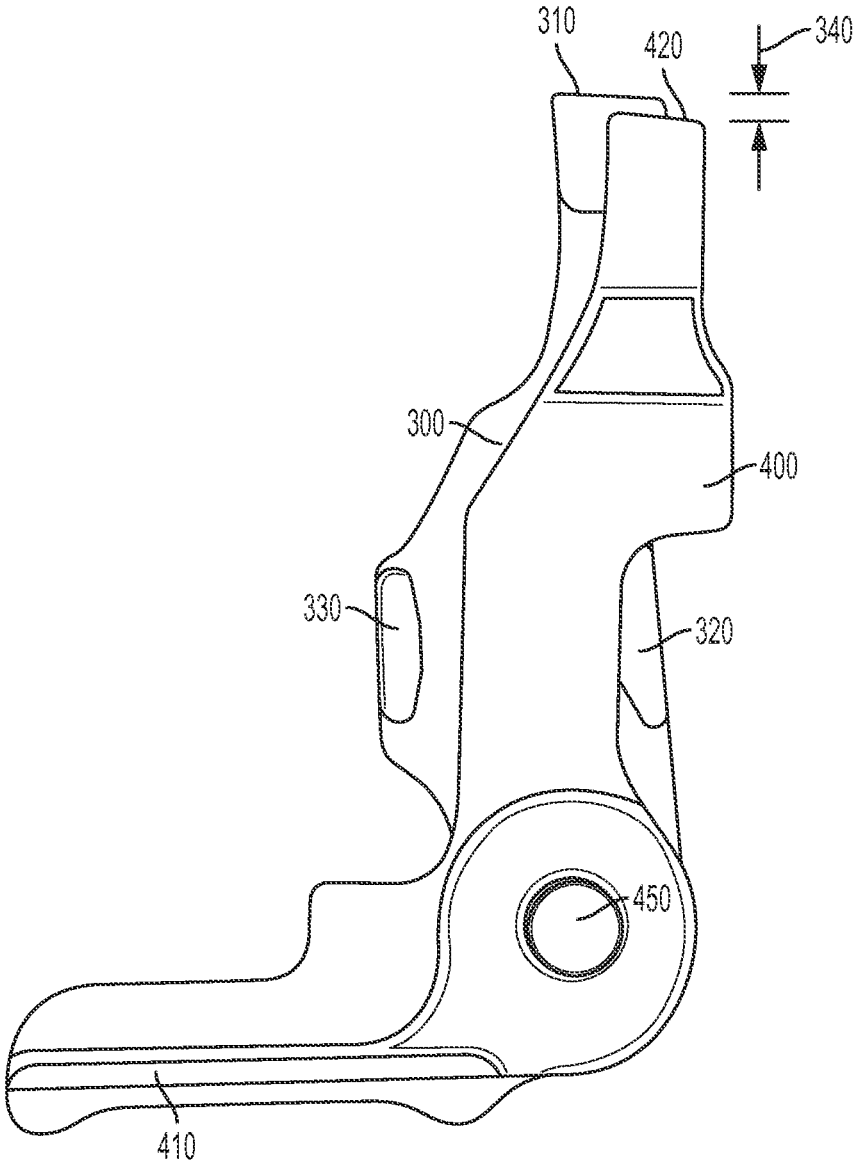
FIG. 9 is a side view of the sear block and the trigger lever of the trigger mechanism of FIG. 1.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof As used herein, the singular forms "a," "an" and "the" include plural referents unless the context clearly dictates otherwise. Thus, for example, reference to a "bolt" includes aspects having two or more bolts unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Terms used herein, such as "exemplary" or "exemplified," are not meant to show preference, but rather to explain that the aspect discussed thereafter is merely one example of the aspect presented.

Additionally, as used herein, relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

In one aspect, presented herein is trigger mechanism 20 for a firearm 10. In one aspect, the firearm 10 is a bolt action rifle having a frame 12, a barrel 14 attached to the frame, a firing mechanism 16 and a trigger mechanism 20.

In one aspect, the trigger mechanism 20 comprises a trigger housing 100 having a front 120, back 110, top 130, and bottom 140. In this aspect, the trigger housing 100 has two spaced side plate elements 150 mountable below the firing mechanism. The trigger mechanism also comprises a trigger assembly body 160 therebetween a portion of the two spaced vertical plate elements;

The trigger mechanism also has a sear 200 pivotally mounted between the plate elements and releasably engagable with a portion of the firing mechanism 16. The sear 200 is moveable between a first position wherein the sear secures the firing mechanism in a cocked position and a second position wherein the sear permits the firing mechanism 16 to be released. As can be seen in the figures, the sear sits below the firing mechanism 16 such that, when the sear 200 drops, the firing mechanism is permitted to release and strike the primer.

In an exemplified aspect, the trigger mechanism 20 comprises a sear block 300 pivotally mounted between the plate elements and has a distal portion 310 releasably engageable with a portion of the sear. The distal portion 310 supports the weight of the sear 200 and the force associated with the sear spring 210 to prevent the sear from falling until desired. The sear block 300 has at least one tab 320 extending therefrom the side face of the sear block. The tab 320 acts as a stop for the trigger lever 400 discussed below.

The trigger mechanism, in another aspect, comprises a trigger lever 400 pivotally mounted between the plate elements adjacent the sear block in side-by-side relation. In this aspect, the proximal portion 410 of the trigger lever is connected with a portion of the trigger 25. The pivot point 450 of the trigger lever and the sear block 300 are substantially the same, in this aspect. In yet another aspect, the trigger lever's distal portion 420 extends upwardly a predetermined distance 340 that is less than the distal portion 310 of the sear block. In one aspect, the distal portion 310 of the sear block extends upward a predetermined distance 340 between about 0.007" and about 0.025" more than the distal portion 420 of the trigger lever 400. In another aspect, the predetermined distance is between about 0.01" and about 0.02". And, in still another aspect, the predetermined distance is about 0.015". Additionally, in this aspect, a portion of the distal portion 420 of the trigger lever is positioned rearward of the distal portion 310 of the sear block 300. In one aspect, a portion of the distal portion of the trigger lever is positioned between about 0.040" and about 0.085" more rearward than the sear block. In another aspect, a portion of the distal portion of the trigger lever is positioned about between about 0.050" and about 0.065" more rearward than the sear block. In yet another aspect, a portion of the distal portion of the trigger lever is positioned about 0.055" more rearward than the sear block.

In one exemplified aspect, the trigger mechanism also has an adjustment mechanism 350 attached to the trigger assembly body 160. The adjustment mechanism 350 is engageable with a portion of the sear block and is used to adjust the sear block in the rearward-forward direction. In this aspect, the trigger assembly body defines a threaded aperture and the adjustment mechanism is a screw. The distal end of the screw engages a portion of the sear block, as shown in the figures.

As can be appreciated, positioning of the trigger lever 400 when the firearm is in the cocked position is maintained by biasing the trigger lever in the rearward direction. In one aspect, the trigger mechanism 20 has a trigger lever bias element 430 in engagement with the trigger lever 400. The trigger lever bias element 430 is configured to exert a force on the trigger lever in the rearward direction to resist movement of the trigger lever in the forward direct. In another aspect, there can be a trigger lever set screw 440 positioned within a portion of trigger assembly body and in engagement with the trigger lever bias element to adjust the force exerted on the trigger lever 400. The trigger assembly body 160 can define a threaded aperture through with the trigger lever set screw 440 can be positioned in order to adjust the level of compression of the trigger level bias element. In yet another aspect, the trigger lever bias element is a spring. It is contemplated that the trigger level bias element can also be an elastomer or other element with spring like qualities.

As can be appreciated, positioning of the sear block 300 when the firearm is in the cocked position is maintained by biasing the sear block in the rearward direction. In one aspect, the trigger mechanism has a sear block bias element 360 in engagement with the sear block 300. The sear block bias element 360 is configured to exert a force on the sear block in the rearward direction to resist movement of the sear block in the forward direct. In another aspect, there can be a sear block set screw 370 positioned within a portion of trigger assembly body and in engagement with the sear block bias element to adjust the force exerted on the sear block 300. The trigger assembly body can define a threaded aperture through with the sear block set screw 370 can be positioned in order to adjust the level of compression of the trigger level bias element. In yet another aspect, the sear block bias element is a spring. It is contemplated that the trigger level bias element can also be an elastomer or other element with spring like qualities.

In use, actuation of the trigger by the user causes the trigger lever to rotate forward toward the at least one tab 320 of the sear block. At some point, the trigger lever will come into contact with the tab 320. As such, further actuation of the trigger causes the trigger lever to engage the tab and move the sear block 300 forward and out of engagement with the sear, which in turn permits the sear 200 to move from the first position to the second position, whereby it falls and permits the actuation of the firing mechanism. After firing, the sear is move back into engagement with the firing mechanism 16 by the sear spring 210, the sear block is moved back under the sear 200 by the sear block spring, and the trigger lever is moved back under the sear by the trigger lever spring. The trigger lever is prevented from moving to far rearward, in one aspect, by a second tab 330 on the sear block configured as a stop for the trigger lever.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. A trigger assembly for cocking and releasing a firing mechanism of a firearm, the trigger assembly having a trigger and comprising:

a trigger housing having a front, back, top, and bottom, the trigger housing comprising two spaced side plate elements mountable below the firing mechanism and a trigger assembly body therebetween a portion of the two spaced vertical plate elements;

a sear pivotally mounted between the plate elements and releasably engagable with a portion of the firing mechanism and moveable between a first position wherein the sear secures the firing mechanism in a cocked position and a second position wherein the sear permits the firing mechanism to be released;

a sear block pivotally mounted between the plate elements and having a distal portion releasably engageable with a portion of the sear, the sear block comprising at least one tab extending therefrom a side face of the sear block; and a trigger lever pivotally mounted between the plate elements adjacent the sear block in side-by-side relation, wherein a proximal portion of the trigger lever is connected with a portion of the trigger, and wherein the trigger lever and the sear block have a pivot point that is substantially the same, the trigger lever having a distal portion that extends upwardly a predetermined distance less than the distal portion of the sear block;

wherein, actuation of the trigger causes the trigger lever to rotate forward toward the at least one tab of the sear block, and wherein further actuation of the trigger causes the trigger lever to engage the at least one tab and move the sear block forward and out of engagement with the sear, which in turn permits the sear to move from the first position to the second position.

2. The trigger assembly of claim 1, wherein a portion of the distal portion of the trigger lever is positioned rearward of the distal portion of the sear block.

3. The trigger assembly of claim 2, wherein a portion of the distal portion of the trigger lever is positioned about between about 0.040" and about 0.085" more rearward than the sear block.

4. The trigger assembly of claim 3, wherein a portion of the distal portion of the trigger lever is positioned about between about 0.050" and about 0.065" more rearward than the sear block.

5. The trigger assembly of claim 4, wherein a portion of the distal portion of the trigger lever is positioned about 0.055" more rearward than the sear block.

6. The trigger assembly of claim 1, an adjustment mechanism attached to the trigger assembly body, the adjustment mechanism engageable with a portion of the sear block to adjust the sear block in the rearward-forward direction.

7. The trigger assembly of claim 1, further comprising a trigger lever bias element in engagement with the trigger lever and exert a force on the trigger lever in the rearward direction to resist movement of the trigger lever in the forward direct.

8. The trigger assembly of claim 7, further comprising a trigger lever set screw positioned within a portion of the trigger assembly body and in engagement with the trigger lever bias element to adjust the force exerted on the trigger lever.

9. The trigger assembly of claim 7, wherein the trigger lever bias element is a spring.

10. The trigger assembly of claim 1, further comprising a sear block bias element in engagement with the sear block and exert a force on the sear block in the rearward direction to resist movement of the sear block in the forward direct.

11. The trigger assembly of claim 10, further comprising a sear block set screw positioned within a portion of the trigger assembly body and in engagement with the sear block bias element to adjust the force exerted on the sear block.

12. The trigger assembly of claim 10, wherein the sear block bias element is a spring.

13. The trigger assembly of claim 1, wherein the predetermined distance is between about 0.007" and about 0.025".

14. The trigger assembly of claim 13, wherein the predetermined distance is between about 0.01" and about 0.02".

15. The trigger assembly of claim 14, wherein the predetermined distance is about 0.015".

16. A firearm, comprising:

a frame;

a barrel attached to the frame;

a firing mechanism having a firing mechanism; and a trigger mechanism, comprising:

a trigger housing having a front, back, top, and bottom, the trigger housing comprising two spaced side plate elements mountable below the firing mechanism and a trigger assembly body therebetween a portion of the two spaced vertical plate elements;

a sear pivotally mounted between the plate elements and releasably engagable with a portion of the firing mechanism and moveable between a first position wherein the sear secures the firing mechanism in a cocked position and a second position wherein the sear permits the firing mechanism to be released;

a sear block pivotally mounted between the plate elements and having a distal portion releasably engageable with a portion of the sear, the sear block comprising at least one tab extending therefrom a side face of the sear block; and a trigger lever pivotally mounted between the plate elements adjacent the sear block in side-by-side relation, wherein a proximal portion of the trigger lever is connected with a portion of the trigger, and wherein the trigger lever and the sear block have a pivot point that is substantially the same, the trigger lever having a distal portion that extends upwardly a predetermined distance less than the distal portion of the sear block;

wherein, actuation of the trigger causes the trigger lever to rotate forward toward the at least one tab of the sear block, and wherein further actuation of the trigger causes the trigger lever to engage the at least one tab and move the sear block forward and out of engagement with the sear, which in turn permits the sear to move from the first position to the second position.

17. The firearm of claim 16, wherein a portion of the distal portion of the trigger lever is positioned rearward of the distal portion of the sear block.

18. The firearm of claim 17, wherein a portion of the distal portion of the trigger lever is positioned about between about 0.040" and about 0.085" more rearward than the sear block.

19. The firearm of claim 18, wherein a portion of the distal portion of the trigger lever is positioned about between about 0.050" and about 0.065" more rearward than the sear block.

20. The firearm of claim 19, wherein a portion of the distal portion of the trigger lever is positioned about 0.055" more rearward than the sear block.

21. The firearm of claim 16, an adjustment mechanism attached to the trigger assembly body, the adjustment mechanism engageable with a portion of the sear block to adjust the sear block in the rearward-forward direction.

22. The firearm of claim 16, further comprising a trigger lever bias element in engagement with the trigger lever and exert a force on the trigger lever in the rearward direction to resist movement of the trigger lever in the forward direct.

23. The firearm of claim 22, further comprising a trigger lever set screw positioned within a portion of the trigger assembly body and in engagement with the trigger lever bias element to adjust the force exerted on the trigger lever.

24. The firearm of claim 22, wherein the trigger lever bias element is a spring.

25. The firearm of claim 16, further comprising a sear block bias element in engagement with the sear block and exert a force on the sear block in the rearward direction to resist movement of the sear block in the forward direct.

26. The firearm of claim 25, further comprising a sear block set screw positioned within a portion of the trigger assembly body and in engagement with the sear block bias element to adjust the force exerted on the sear block.

27. The firearm of claim 25, wherein the sear block bias element is a spring.

28. The firearm of claim 16, wherein the predetermined distance is between about 0.007" and about 0.025".

29. The firearm of claim 28, wherein the predetermined distance is between about 0.01" and about 0.02".

30. The firearm of claim 29, wherein the predetermined distance is about 0.015".

* * * * *